United States Patent [19]

Schabert et al.

[11] Patent Number: 4,793,779

[45] Date of Patent: Dec. 27, 1988

[54] ROTATING PISTON COMPRESSOR HAVING AN AXIALLY ADJUSTABLE ROTARY SLEEVE VALVE

[75] Inventors: Hans-Peter Schabert, Erlangen; Max Heller, Uttenreuth; Klaus Zach, Erlangen, all of Fed. Rep. of Germany

[73] Assignee: Kraftwerk Union Aktiengesellschaft, Mülheim, Fed. Rep. of Germany

[21] Appl. No.: 35,501

[22] Filed: Apr. 3, 1987

[30] Foreign Application Priority Data

Apr. 4, 1986 [DE] Fed. Rep. of Germany ..... 3611326

[51] Int. Cl.[4] ..... F04C 18/356; F04C 29/08; F04C 23/00

[52] U.S. Cl. ..... 418/60; 418/63; 418/270; 417/516; 137/624.15

[58] Field of Search ..... 418/63, 60, 270, 152; 417/516, 529, 295, 362; 137/625.17, 624.15, 625.19, 625.47, 246, 246.22; 251/368

[56] References Cited

U.S. PATENT DOCUMENTS

| | | | |
|---|---|---|---|
| 1,990,263 | 2/1935 | Benedek | 417/516 |
| 2,063,503 | 12/1936 | Hermsdorf et al. | 418/60 |
| 3,208,388 | 9/1965 | Glasgow | 417/362 |
| 3,224,462 | 12/1965 | Lopker | 137/625.19 |
| 3,535,059 | 10/1970 | Kalkbrenner | 418/60 |
| 3,650,295 | 3/1972 | Smith | 137/624.15 |
| 3,867,075 | 2/1975 | Horst | 137/625.17 |
| 4,245,968 | 1/1981 | Buschbom et al. | 137/246 |

FOREIGN PATENT DOCUMENTS 3343908 6/1984 Fed. Rep. of Germany .

*Primary Examiner*—John J. Vrablik
*Assistant Examiner*—Leonard P. Walnoha
*Attorney, Agent, or Firm*—Herbert L. Lerner; Laurence A. Greenberg

[57] ABSTRACT

A rotating piston compressor includes a cylinder having inlet and outlet openings formed therein, a piston rotating in a given direction in the cylinder, a shaft supporting the piston and rotating in the given direction, a casing connected to the cylinder and having slits formed therein, a control device for controlling flow through the inlet and outlet openings in the form of a rotary slide disposed outside the cylinder in the casing, the rotary slide being connected to the shaft for a steady, synchronized rotational movement, and the relative position of the rotary slide and the casing being adjustable.

14 Claims, 4 Drawing Sheets

ROTATING PISTON COMPRESSOR HAVING AN AXIALLY ADJUSTABLE ROTARY SLEEVE VALVE

The invention relates to a rotating piston compressor having a piston rotating in a cylinder and being supported by a shaft rotating in the same direction, the cylinder having inlet and outlet openings provided with control devices.

In conventional rotating piston compressors, the control devices are in the form of flaps or valves, especially spring-loaded flaps or valves, which open or close the flow cross section with a virually rectinlinear movement. Such control devices are not suitable for rapid switching, which is required at high rpm, due to the reciprocating movement thereof.

It is accordingly an object of the invention to provide a rotating piston compressor, which overcomes the hereinafore-mentioned disadvantages of the heretofore-known devices of this general type and to improve such rotating piston compressors in such a way that they are also suitable for high rpm. This is particularly important for mechanically driven rotating piston compressors that are rigidly coupled to an internal combustion engine and are used for supercharging the engine.

With the foregoing and other objects in view there is provided, in accordance with the invention, a rotating piston compressor, comprising a cylinder having inlet and outlet openings formed therein, a piston rotating in a given direction in the cylinder, a shaft supporting the piston and rotating in the given direction, a casing connected to the cylinder and having slits formed therein, a control device for controlling flow through the inlet and outlet openings in the form of a rotary slide disposed outside the cylinder in the casing, means for connecting the rotary slide to the shaft for a steady, synchronized rotational movement, and means for adjusting the relative position of the rotary slide and the casing.

The term rotary slide is intended to refer to a roller-shaped body, so that openings provided in the periphery thereof alternatingly communicate with the slits in the casing, which may also be an integral component of the compressor housing. The adjustment of the relative position which serves to change the flow cross sections, takes place primarily in the axial direction.

According to the invention, the conventional outlet valves, which in particular operate as check valves, are replaced by rotary slides. This makes it possible to reach high speeds of far more than 5000 rpm, while avoiding fluttering as occurs with valves and avoiding a static pressure loss caused by excessive spring tension.

According to the invention, a rotary slide disposed on the compression side can be controlled in such a way that it opens as soon as the pressure in the cylinder has risen to the counterpressure of the pressure line. The corresponding rotational angle of the piston is, for example, approximately 160° in the case of a rotating piston compressor that compresses from 1000 hPa to 2000 hPa. The rotary slide then closes again at 360°=0°, at dead center of the rotating piston. If a higher counterpressure has been set, then the rotary slide will also not open until later, such as after a rotational angle of the piston of 200°.

A rotary slide can also be used in the intake side of the rotating piston compressor, where it permits continuous regulation of the aspirated gas quantity at a fixed rpm.

For example, the rotary slide can open at a crankshaft angle of between 0° and 25° of the shaft carrying the cylinder, and can close at a crankshaft angle of a maximum of 30°. The maximum pumping quantity of the compressor is attained at the closing angle of 360° that is the rotary valve remains virtually continuously open. At smaller closing angles, which bring about a shorter charging time, the aspirated gas quantity decreases, as also occurs with a gradual closing of the throttle valve in a motor vehicle. In comparison with throttle regulation, which is associated with pronounced losses, the construction according to the invention, provides a means of periodic, intermittent charge quantity regulation, yielding substantially better efficiency.

In accordance with another feature of the invention, the connecting means are a form-locking connection in the form of gear wheels, a gear chain or a toothed belt. A form locking connection is one in which parts are locked together by virtue of their shapes, as opposed to a force-locking connection, which is accomplished by outside force.

In accordance with a further feature of the invention, the connecting means include means for moving the rotary slide faster in the closing direction than in the opening direction.

In accordance with an added feature of the invention, the connecting means include at least one non-round, preferably oval gear wheel.

In accordance with an additional feature of the invention, the connecting means include two elliptical gear wheels meshing with one another.

In accordance with yet another feature of the invention, the connecting means include a flat four-bar coupling with a reduction gear.

With non-round gear wheels, it is possible to obtain periodically non-uniform rotary slide movements, which enable fast closing after a long period with a large flow cross section. This reduces the small throttle losses that still occur even with charge quantity regulation.

Another improvement in regulating the suction performance is attained by providing that the rotary slide is not only adjustable in the axial direction with respect to the casing, for varying the flow cross section, but is also rotatable by an angle smaller than ±90°, for example 80° because the variation of the opening cross section over a period of time can even better detect the instantaneous intake volume flow during the rotation.

Therefore, in accordance with yet a further feature of the invention, the adjusting means include means for axially adjusting the rotary slide relative to the casing for varying the flow cross section.

In accordance with yet an added feature of the invention, the adjusting means include means for axially adjusting the casing surrounding the rotary slide.

In accordance with yet an additional feature of the invention, the axially adjustable casing is rotatable about an angle smaller than ±90°.

In accordance with still another feature of the invention, the cylinder includes an end surface at which the connecting means are disposed for driving the rotary slide and an opposite end surface, and the adjusting means are disposed at the opposite end surface of the cylinder for moving the casing.

It can be advantageous for the casing to be actuated on the end surface opposite the rotary slide drive means, because this avoids an intervention in the vicinity of the actuation members of the rotary slide. However, according to one embodiment, it is possible to allow the adjustment means to engage the rotary slide and to place it on one side together with its drive means, in a space-saving manner.

In accordance with still a further feature of the invention, the adjusting means include a restoring spring biasing the casing or the rotary slide. Simplification of the control of the casing or of the rotary slide is possible if these elements are subject to the action of a restoring spring. With the restoring spring, the intake quantity of the rotating piston compressor can be regulated to a minimum value, such as that which is suitable as an idling speed for an internal combustion engine. In that case, a coupling to the gas pedal can be provided, as well as an idling adjustment screw.

In accordance with still an added feature of the invention, the rotary slide is formed of metal and rotates in the casing, the casing is formed of fiber-reinforced plastic, and including a lubricant, such as graphite or molybdenum sulfide, disposed between the rotary slide and the casing. Plastic and metal are paired in view of wear resistance and dry-running, i.e., non-lubricated properties.

In accordance with still an additional feature of the invention, the casing is disposed in the cylinder with a gap therebetween defining a diametric play of at least 0.1 mm.

In accordance with again another feature of the invention, there is provided a seal, especially a sealing strip, disposed in the gap between the casing and the cylinder. It is particularly advantageous for the plastic casing to be built into the housing with play, so that it can expand locally if a temperature spike occurs at a friction point.

In accordance with again a further feature of the invention, the rotary slide has oppositely disposed openings formed therein providing a flow diametrically therethrough.

In accordance with again a further feature of the invention, there are provided means for rotating the rotary slide at a speed substantially between one-half and one-third that of the shaft.

In accordance with again an added feature of the invention, the piston is formed of two mutually circumferentially offset piston parts, and the rotary slide for the piston parts has flow openings formed therein being offset in circumferential direction. This is done in rotating piston compressors having two piston parts that are offset from one another in the circumferential direction, which is favorable for uniform pumping. The offset may be 90°, for example.

In accordance with again an additional feature of the invention, the rotary slide also has slits formed therein, and all of the slits are triangular or trapezoidal and optionally have swung-out sides.

In accordance with still another feature of the invention, the adjusting means displace the rotary slide in a given direction, and one side of the triangular or trapezoidal slits coincides with the displacement direction of the rotary slide in a standstill condition.

In accordance with still another feature of the invention, the slits are spaced apart by webs having given dimensions and the slits have dimensions in the circumferential direction substantially equal to twice the given dimensions.

In accordance with still an added feature of the invention, the triangular slits have cut-off or rounded points.

In accordance with still an additional feature of the invention, the triangular slits have given axial dimensions, and the adjusting means adjust the rotary slide and the casing relative to one another over an axial adjustment path being longer than the given axial dimensions.

In accordance with another feature of the invention, there is provided a curved toothed coupling driving the rotary slide and transmitting rotational movement, the adjusting means including a pushrod coaxial to the coupling for axial adjustment.

In accordance with a further feature of the invention, the curved toothed coupling has teeth disposed at an oblique angle of substantially 45° with respect to the axis.

In an internal combustion engine, the opportunity to regulate with the rotary slide should also be available during cold starting of the engine. To this end, as long as the engine is still cold, not only should the cooling of the aspirated air that occurs at partial load be compensated for, but if possible additional heat should be supplied to it. In order to accomplish this objective, in accordance with a concomitant feature of the invention, the cylinder has local regions being mutually offset on the periphery thereof, and including an internal throttle bypass interconnecting the local regions or interconnecting the piston parts rotating in an offset manner.

Other features which are considered as characteristic for the invention are set forth in the appended claims.

Although the invention is illustrated and described herein as embodied in a rotating piston compressor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
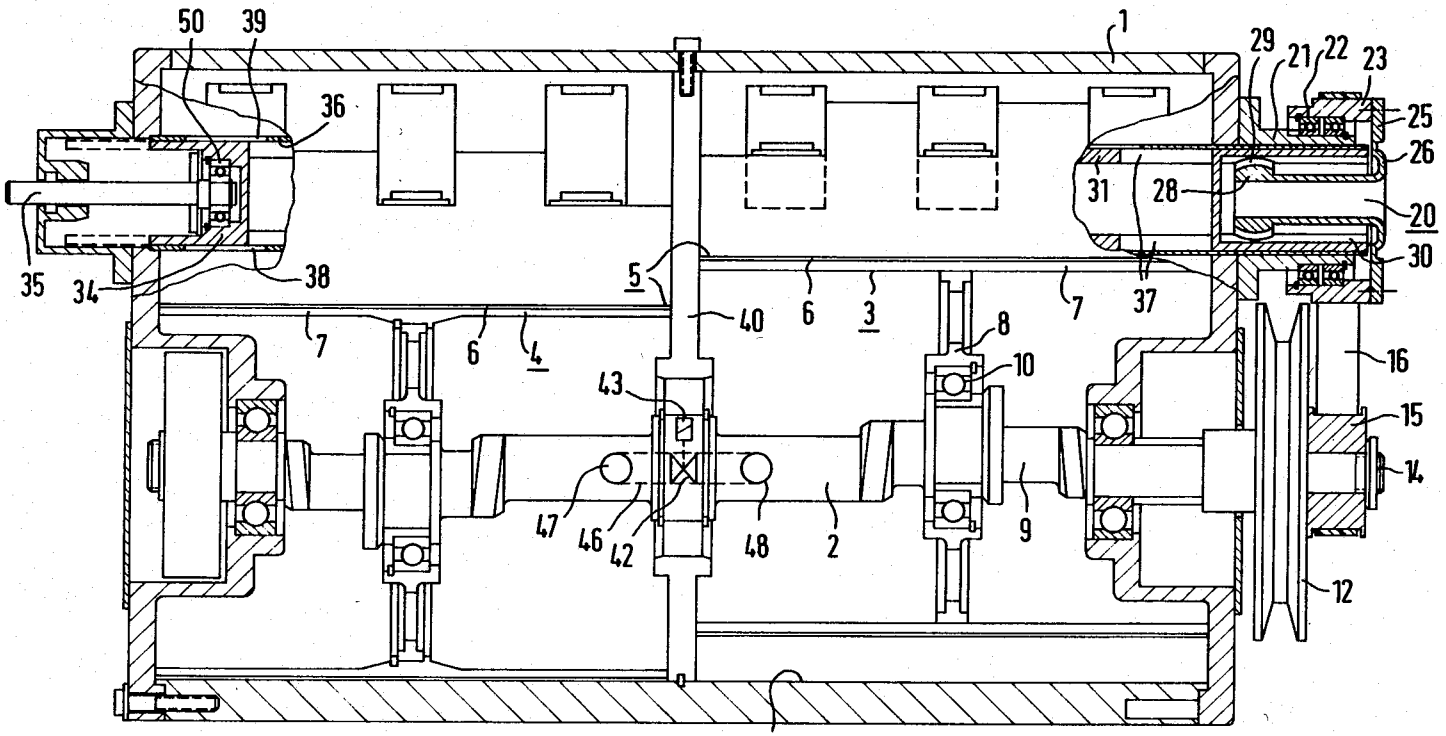
FIG. 1 is a diagrammatic, partly broken-away, longitudinal-sectional view parallel to the shaft of a rotating piston compressor.
Figure 2:
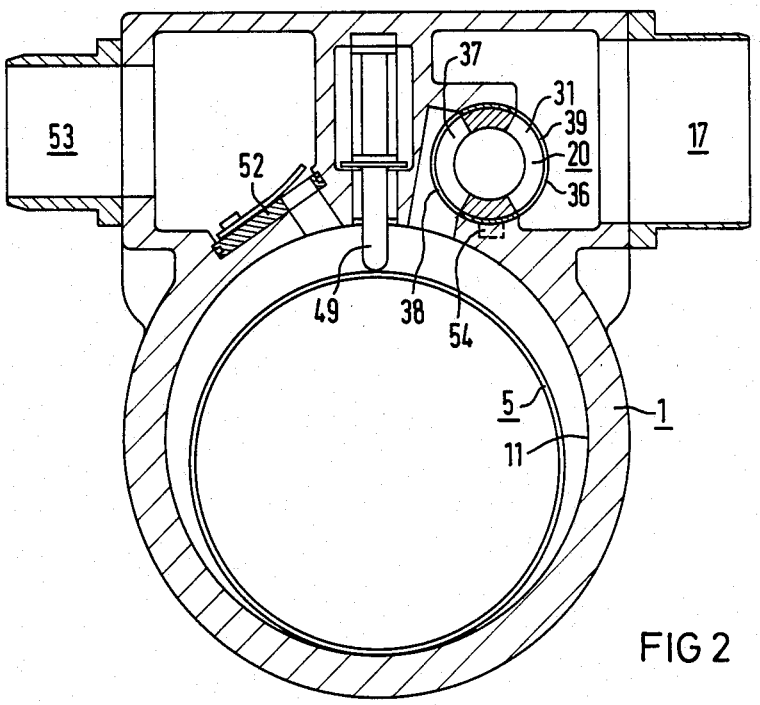
FIG. 2 is a cross-sectional view of the compressor.

Referring now to the figures of the drawings in detail and first, particularly, to FIGS. 1 and 2 thereof, there is seen a rotating piston compressor constructed in tandem, including a housing or cylinder 1 of lightweight cast metal, in which a shaft 2 carries two piston parts 3 and 4 of a rotating piston 5, which are mutually offset by 180°. The two piston parts 3 and 4 which are identically constructed, surround cylindrical pipe segments 6 which are formed of stainless steel, have a wall thickness of 1.2 mm, for example, and a diameter of 145 mm. The pipe segments 6 are retained on a hub body 8 by a thin-walled shell 7; the hub body 8 is secured by a ball bearing 10 on a cranked or offset section 9 of the shaft 2, so that the piston part 3 is pressed elastically against the wall 11 of the cylindrical housing 1. The suction performance of the compressor amounts to 500 $m^3/h$.

As shown at the right-hand side of FIG. 1, in addition to the housing 1, the shaft 2 has a belt pulley 12 for a V-belt, with which a connection with a non-illustrated internal combustion engine is established. Another belt pulley 15, on which a toothed belt or chain 16 is disposed, is mounted on a shaft end 14 located in front of the belt pulley 12. The toothed belt 16 establishes a connection with a rotary slide 20, which is disposed in an inlet opening 17 and is supported in the housing 1 as a regulating device on the intake side.

The rotary slide 20 protrudes into a pipe fitting or socket 21 which is formed by the housing 1 and has a ball bearing 22 which supports a toothed belt pulley 23. The flange 25 of a hollow shaft 26 is flexibly secured on the toothed belt pulley 23 and the hollow shaft 26 protrudes into the pipe fitting 21. In the pipe fitting 21, the free end of the hollow shaft has a cap piece 28 which is provided with curved toothing or a curved toothed coupling 29 that engages grooves 30 formed in another hollow shaft 31, in order to form the main portion of the rotary slide 20.

The other hollow shaft 31 is formed of metal, such as stainless steel. At the end surface of the housing remote from the toothed belt pulley 23 and the V-belt pulley 12, the other hollow shaft 31 is provided with an inwardly projecting flange 34, which is engaged by a push rod 35 having a ball bearing 50. The rod 35 can axially displace the hollow shait 31 relative to a plastic casing or jacket 36, which tightly surrounds the hollow shaft 31 of the rotary slide 20. Slits 37, 38, which may be triangular or trapeziodal, extend partly obliquely both in the casing 36 and in the hollow shaft 31. The slits establish a variable flow cross section by axially displacing the hollow shaft 31, depending on the rotary position of the rotary slide 20. In this manner, the intake quantity and thus the pumping performance of the rotating piston compressor can be varied within wide limits.

The tandem-type rotating piston compressor has a central partition 40 between the two piston parts 3 and 4. A valve 42 which is disposed in the housing 1 in the vicinity of the central partition 40, can be actuated by a magnet 43. The valve 42 establishes an internal throttle bypass between the two cylinder parts, wherein the parts communicate with one another through a longitudinal bore 46 and transverse bores 47 and 48. The bypass facilitates cold starting of an internal combustion engine having a rotating piston compressor. As long as the bypass is kept open, a reciprocating loss-inducing airflow takes place, which has the effect of heating the aspirated air. Alternatively, the bypass can also be disposed in such a way that it causes portions of the periphery of the cylinder 1 that are remote from one another to communicate with one another.

FIG. 2 shows a partitioning slide 49 which is located along side the rotary slide 20 and is disposed against the piston 5 due to the action of springs, so that the inlet opening 17 is separated from a pressure line 53 provided with check valves 52. Also shown in broken lines in FIG. 2 is a resilient sealing strip 54, which seals off the casing 36 with respect to the housing 1.

Figure 3:
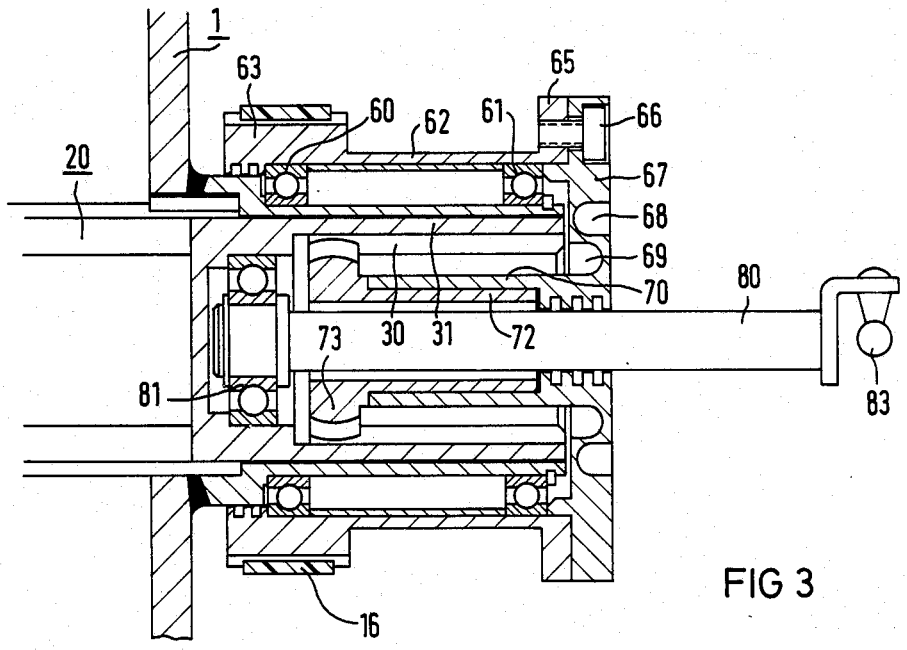
FIG. 3 is a fragmentary, enlarged, sectional view taken along the axis of a rotary slide, showing the drive and adjustment of the rotary slide from the same side.

FIG. 3, which is a section taken along the axis of the rotary slide 20, shows another type of actuation of the rotary slide 20. In the FIG. 3 device, the drive and adjustment means engage the same side of the rotary slide. To this end, a pipe segment 62 is supported with two spaced-apart ball bearings 60 and 61 on the housing 1 of the rotating piston compressor. The pipe segment is widened into a gear wheel 63 on the side thereof facing toward the housing 1. The gear wheel 63 is engaged by the toothed belt 16, which leads to the shaft 2 of the rotating piston compressor. The other end of the pipe segment 62 is shaped into a flange 65. A counter flange 67 is secured by screws 66 at the flange 65. The counter flange is given flexibility with respect to the axial direction by means of notches 68 and 69. The flange 67 has a hollow shaft segment 70, pointing toward the housing 1. A counter segment 72 having curved toothing 73 disposed on the end thereof is inserted into the hollow shaft segment 70. The curved toothing or toothed coupling 73 in turn engages the grooves 30 in the hollow shaft 31 of the rotary slide 20.

Protruding through the flange 67 is a bar 80, which is fixed in the hollow shaft 31 with a ball bearing 81. The bar 80 serves to adjust the rotary slide 20 in the longitudinal direction. To this end, the bar is provided with a spherical actuating knob 83 on the end thereof remote from the rotary slide 20. The non-illustrated linkage of the gas pedal acts upon the actuating knob 83. Thus in the embodiment according to FIG. 3, the drive of the rotary slide 20 and its axial adjusting device are provided on the same end and are structurally combined into the most compact space possible.

Figure 4:
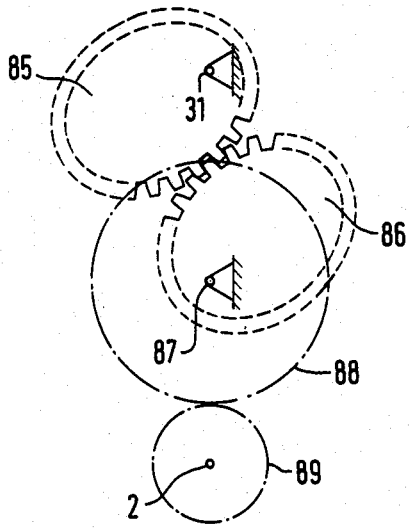
FIGS. 4, 5 and 6 are diagrammatic, elevational views of a drive for periodic non-uniform movement of the rotary slide.
Figure 5:
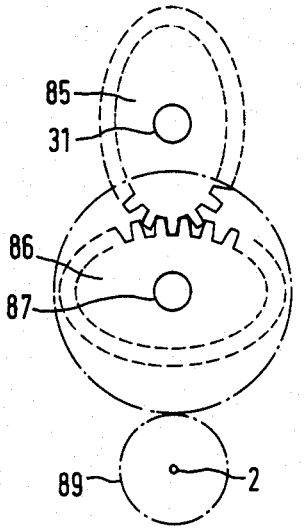
Figure 6:
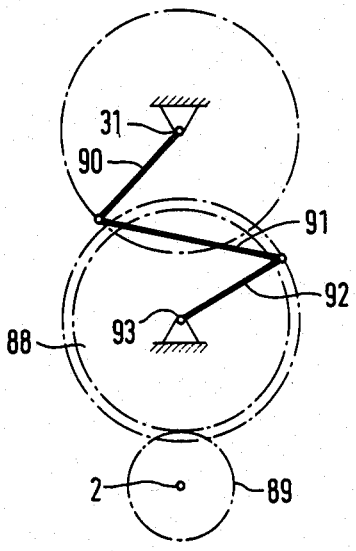

FIGS. 4, 5 and 6 diagrammatically illustrate that the actuation of the rotary slide 20 by the shaft 2 of the rotating piston compressor can also be carried out in such a way that the hollow shaft 31 of the rotary slide 20 periodically rotates non-uniformly. Thus the duration of the fully opened flow cross section of the slide 20 can be increased as compared with the duration in the closed position, so that a particularly high throughput and rapid closure are attained.

According to FIG. 4, in order to generate the non-uniform but periodic motion, there are provided two elliptical gear wheels 85 and 86 which mesh with one another. The gear wheel 85 is mounted eccentrically in such a way that one focus is on the hollow shaft 31 of the rotary slide 20, and the gear wheel 86 is also eccentrically mounted on an intermediate shaft 87. The intermediate shaft 87 is joined to a layshaft or constantly meshing gear wheel 88, which meshes with a smaller layshaft or constantly meshing gear wheel 89. The gear wheel 89 is mounted on the shaft 2 of the rotating piston compressor. Depending on the dimensions of the ovalizing and the ratios of the gear wheels 88 and 89, the rotary speed can be varied in a proportion from 1:2. The same gear ratios are also found in the embodiment of FIG. 5. In FIG. 5, the oval gear wheel 85 and the oval gear wheel 86 are not supported at the focus of an ellipse determining the gear wheel circumference, but rather in the center point of the gear wheel. The maximum speed of the rotary slide 20 in this case has the same relationship with the minimum speed as the inverse ratio of the gear wheel radii.

Other non-round gear wheel shapes are possible, such as a combination of an eccentric circular wheel with an oval gear wheel. In this case the 1:2 gearing would be dropped.

FIG. 6 shows that a periodic non-uniform movement of the rotary slide 20 can also be attained with a four-bar coupler. The four-bar coupler includes a first crank 90 which is joined to the hollow shaft 31 of the rotary slide 20. The crank 90 is joined by a connecting rod 91 to a second crank 92, which is mounted on an intermediate shaft 93 carrying the gear wheel 88. The gear wheel 88 meshes with the layshaft or constantly meshing gear wheel 89. This mechanism, which is in the form of an anti-parallel crank mechanism, permits ratios of the minimum to the maximum rotary slide speed of approximately 1:3.5.

Figure 7:
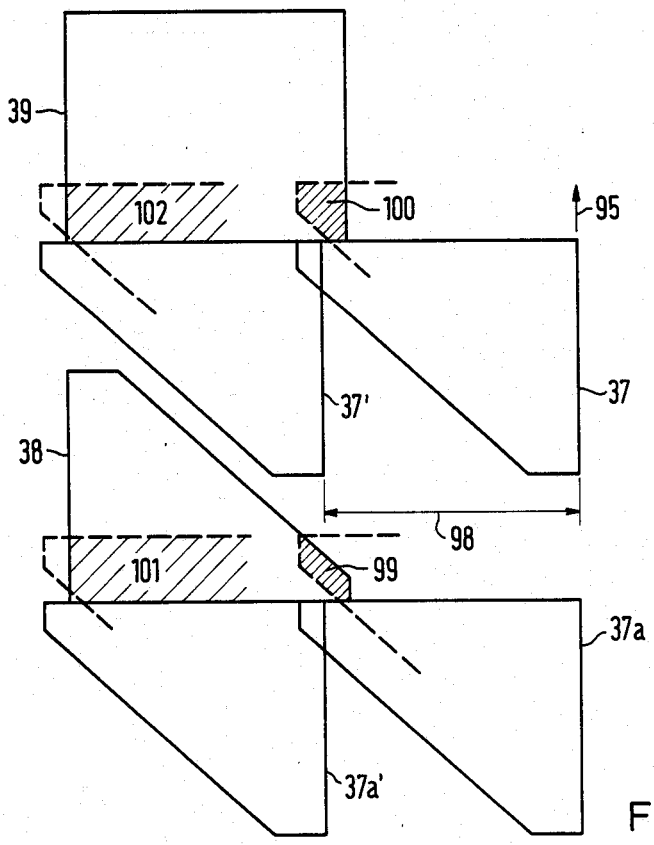
FIGS. 7 and 8 are developed views of the rotary slide showing flow cross sections and the variation thereof by means of adjusting the rotary slide and casing or jacket.

FIG. 7 illustrates a development of the casing 36 and the rotary slide 20, having a diameter of 40 mm, for example, in a case in which the rotary slide 20 is driven at half the rpm of the shaft 2. The casing 36 and rotary slide 20 experience a crosswise flow of gas therethrough from the intake side. They each have two slits 37 on the periphery thereof which are mutually offset by 180°, in the form of the two triangular slits 37, 37*a* in the rotary slide 20 and the slits 38 and 39 in the casing 36. The slit 38 in the casing 36 that communicates with the cylinder 1 has a triangular shape similar to that of the slits 37, 37*a* of the rotary slide 20. However, the triangle 38 is upside-down. On the other hand, the slit 39 in the casing 36 that communicates with the intake line 17 is rectangular.

In the rotary position of the rotary slide 20 which is shown, the slits 37, 37*a* thereof do not coincide with the slits 38, 39 of the casing 36. A crosswise flow of the aspirated air is prohibited. If the rotary slide 20 is rotated by 30°, for example (corresponding to a crank angle of 60° for the shaft 2), then the slit 37 migrates upward, in the direction of an arrow 95, into the position represented by broken lines. In so doing, the two small, more darkly shaded flow cross sections 99, 100 are uncovered, and a small airflow can be initiated, such as is necessary for instance during idling of the engine. The air flow is cut off again after a brief further rotation, by the oblique edges of the triangles 37*a* and 38.

Upon displacement of the rotary slide 20 toward the left by a stroke 98, which may be 40 mm in length, the slits 37, 37*a* enter the positions 37′, 37*a*′. They then coincide with the slits 38, 39 to a much greater circumferential extent, resulting in flow cross sections 101, 102 represented by lighter shading. They also remain open over a large rotary angle range. The axial displacement 98 of the rotary slide 20 thus brings about a sharp increase in the suction of the compressor and leads to a rise in the intake pressure in the connecting pipeline 53 leading to the engine.

Figure 8:
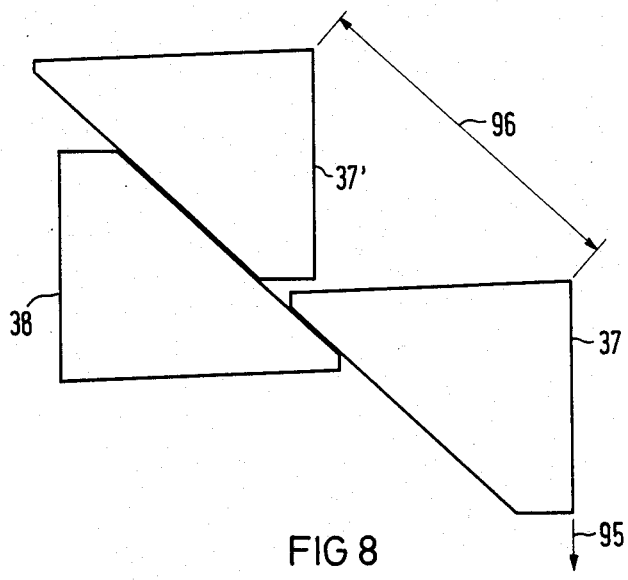

In FIG. 8, the rotational direction of the rotary slide 20 is reversed. In the development shown, the orientation of the arrow 95 is downward. The beginning of the slit coincidence, that is the beginning of flow therethrough, is at the oblique sides of the triangles represented by the slit 37 in the rotary slide 20 and the slit 38 in the casing 36. The coincidence and thus the flow, terminate at the instant at which the approximately axially parallel sides of the triangle overtake one another.

It is a particular advantage that the opening surface area reaches its maximum value somewhat later than in the case of the theoretically approximately sinusoidal course of the flow of the volume in the rotating piston compressor during aspiration. In this manner, the inertia of the actual air column is taken into account, in the sense that the throttle losses in the open slit cross section, that is in the coincidence of the openings 38 and 37, are minimized. The prerequisite for this provision is that the chronological onset of the opening (for example, at 0°). is independent of the axial position of the rotary slide 20. A rotation in the circumferential direction between the rotary slide 20 and its toothed belt pulley 23 (such as through ±85°) must accordingly be superimposed on the displacement stroke 98 (of 40 mm), so that the adjustment takes the overall course indicated by the arrow 96. To this end, the teeth of the curved intermediate toothed segment 29 are rotated toward the rotary slide 20 by 45° relative to the axis. The control of the charge quantity is effected by compression or tension at the opposite end (if there is an angle of 45°, the danger of automatic locking or self-inhibition from tooth friction is at a minimum).

The shape of the triangular or trapeziodal slit 37 is selected in such a way that the longer oblique side coincides with the displacement direction of the rotary slide 20. The opposite side is either axially parallel or not. In the circumferential direction, the slits 37 cover approximately 64% (2×32%) of the hollow shaft 31 of the rotary slide, while the webs of material therebetween cover the remaining angle of 36% (2×18%).

In the circumferential direction the slits 37 are shortened, for example by 20% of the original width of the triangle, in order to be able to place the widest possible slit 37 on the periphery of the rotary slide 20. Although this shortening lowers the speed of the change in surface area that can be attained with virtually complete opening shortly before the shutoff of the flow, nevertheless, since the flow has already dropped greatly on its own (following a sinusoidal course), the resultant throttle loss is modest.

The axial stroke of the rotary slide 20 can be greater than the length of the original triangular slit, such as by 15%, for example. The result is a particularly large flow cross section, or particularly low throttle losses at full load.

We claim:

1. Rotating piston compressor, comprising a cylinder having inlet and outlet openings formed therein, a piston rotating in a given direction in said cylinder, a shaft supporting said piston and rotating in said given direction, a casing connected to said cylinder and having slits formed therein, a control device for controlling flow through said inlet opening in the form of a rotary slide disposed outside said cylinder in said casing, connecting means for connecting said shaft to a curved tooth coupling, said curved tooth coupling driving said rotary slide for connecting said rotarty slide to said shaft for a rotational movement, and a pushrod coaxial to said coupling for adjusting the relative position of said rotary slide and said casing.

2. Rotating piston compressor according to claim 1, wherein said connecting means are in the form of gear wheels.

3. Rotating piston compressor according to claim 1, wherein said curved tooth coupling is connected to said shaft by a toothed belt.

4. Rotating piston compressor according to claim 2, wherein said connecting means include means for moving said rotary slide faster in the closing direction than in the opening direction.

5. Rotating pisotn compressor according to claim 1, wherein said connecting means include at least one non-round gear wheel.

6. Rotating piston compressor according to claim 1, wherein said connecting means include two elliptical gear wheels meshing with one another.

7. Rotating piston compressor according to claim 1, wherein said connecting means include a flat four-bar coupling with a reduction gear.

8. Rotating piston compressor according to claim 1, wherein said pushrod axially adjusts said rotary slide relative to said casing for varying the flow cross section.

9. Rotating piston compressor according to claim 1, wherein said cylinder includes an end surface at which said curved tooth coupling is disposed for rotatingly driving said rotary slide and an opposite end surface, and said pushrod being disposd at sad opposite end surface of said cylinder for axial movement.

10. Rotating piston compressor according to claim 1, wherein said rotary has oppositely disposed openings formed therein providing a flow diametrically therethrough.

11. Rotating piston compressor according to claim 10, including means for rotating said rotary slide at a speed substantially between one-half and one-third of said shaft.

12. Rotating piston compressor according to claim 1, wherein said piston is formed of two mutually circumferentially offset piston parts, and said rotary slide for said piston parts has flows openings formed therein being offset in circumferential direction.

13. Rotating piston compressor according to claim 1, wherein said rotary slide also has slits formed therein, and all of said slits are triangular and have cut-off points.

14. Rotating piston compressor according to claim 1, wherein said curved toothed coupling has teeth disposed at an oblique angle of substantially 45° with respect to the axis.

* * * * *